United States Patent [19]

Haynes

[11] Patent Number: 4,787,226

[45] Date of Patent: Nov. 29, 1988

[54] ROLL ADJUSTMENT METHOD

[75] Inventor: Ralph G. Haynes, Yorkshire, England

[73] Assignee: Davy McKee (Sheffield) Limited, Sheffield, England

[21] Appl. No.: 57,085

[22] Filed: Jun. 3, 1987

[30] Foreign Application Priority Data

Jun. 3, 1986 [GB] United Kingdom ..... 8613353

[51] Int. Cl.[4] ..... B21B 1/10; B21B 13/12; B21B 37/08

[52] U.S. Cl. ..... 72/20; 72/21; 72/225; 72/238

[58] Field of Search ..... 72/225, 247, 20, 21, 72/237, 238, 365, 366

[56] References Cited

U.S. PATENT DOCUMENTS

| | | | |
|---|---|---|---|
| 3,968,672 | 7/1976 | Kamogawa et al. | 72/225 |
| 4,127,997 | 12/1978 | Quehen | 72/225 |
| 4,702,099 | 10/1987 | Sturm | 72/225 X |

FOREIGN PATENT DOCUMENTS

| | | |
|---|---|---|
| 1935604 | 1/1971 | Fed. Rep. of Germany . |
| 3501622 | 7/1986 | Fed. Rep. of Germany . |
| 1534515 | 12/1978 | United Kingdom . |

*Primary Examiner*—Robert L. Spruill
*Assistant Examiner*—Steven B. Katz
*Attorney, Agent, or Firm*—Foley & Lardner, Schwartz, Jeffery, Schwaab, Mack, Blumenthal & Evans

[57] ABSTRACT

A method of aligning the horizontal and vertical rolls of a beam mill stand. First the upper horizontal roll is brought to a datum position, and then the vertical rolls are brought into contact with the opposite flanks of upper horizontal roll, to establish datum positions for the vertical rolls. The vertical rolls are then withdrawn from their datum positions, and the lower horizontal roll is brought into contact with the upper horizontal roll to establish a datum position for the second horizontal roll. The vertical rolls are brought into contact with the flanks of the upper and lower horizontal rolls. The initial inter-roll spacing of the vertical rolls at first contact is compared with the inter-roll spacing of the vertical rolls at the second contact to determine if there is any axial misalignment of the horizontal work rolls. If the vertical rolls are withdrawn by a predetermined amount, and the horizontal rolls are separated, one of the horizontal rolls axially maybe adjusted to correct the determined misalignment, and the horizontal rolls are brought together again. Finally the vertical rolls are again brought into contact with the flanks of the horizontal rolls.

11 Claims, 2 Drawing Sheets

ROLL ADJUSTMENT METHOD

FIELD OF THE INVENTION

The present invention relates to the adjustment of the rolls of a beam mill stand, and in particular, though not exclusively, to a method of "zeroing" the position of the mill rolls in advance of rolling.

BACKGROUND ART

In the past the setting up of the rolls of a beam mill prior to rolling has mainly been done by skilled trial and error. Knowing a beam of certain dimensions is required the rolls are, in the practice of the art, set to approximately the correct spacing using the roll adjustment gear, and a trial length of beam is run off. The dimensions of the resulting beam are then checked and compared with the requirements, and the positions of the horizontal and vertical rolls of the beam mill adjusted to diminish any error. A further trial length of beam is run off, and the procedure repeated for as many times as it takes to bring the produced beam dimensions within the tolerances of the required product. Clearly this method is both wasteful of raw materials and time.

It has been suggested to apply automatic gap control technology as used on strip mills, to beam mills. Thus accurate positioning becomes possible, but the existing method of setting up by trial and error are not suited to the new technology, and certainly do not take advantage of the accuracy possible with such a feedback system. The known AGC systems have a sensor which detects the pressure applied to a roll by sensing the pressure in a hydraulic capsule supporting the roll chock, and another sensor which detects the actual position of the roll and senses any variation in that position. In strip mills the sensed variations in hydraulic pressure in the capsule is used during rolling to correct the rolling load. The position sensors are used to initialise the positions of the pair of rolls used.

A major deficiency with the prior approach was the lack of any proper relative alignment of the rolls prior to rolling commencing.

SUMMARY OF THE INVENTION

An object of the present invention is to provide a method for initialising the alignment of the rolls of a beam mill stand.

According to one aspect of the invention there is provided a method of aligning the horizontal and vertical rolls of a beam mill stand comprising the steps of:

(a) bringing a first of the horizontal rolls to a datum position, (b) bringing the vertical rolls into contact with the first horizontal roll, to establish a datum position for the vertical rolls, (c) withdrawing the vertical rolls from their datum positions, (d) bringing the second horizontal roll into contact with the first horizontal roll, and (e) bringing the vertical rolls into contact with the upper and lower horizontal rolls.

Provided the horizontal rolls are correctly axially aligned this method is usually sufficient to bring all four rolls to a correct datum from which their positions can be adjusted to roll a beam of desired dimensions. However, should the horizontal rolls be mis-aligned axially, the further steps may be necessary for proper alignment.

Preferably the method includes the additional steps of:

(f) comparing the inter-roll spacing of the vertical rolls at step (b) with the inter-roll spacing of the vertical rolls at step (e) to determine if there is any axial misalignment of the horizontal work rolls, (g) withdrawing the vertical rolls by a predetermined amount, (h) separating the horizontal rolls, axially adjusting one of the horizontal rolls to correct the determined misalignment, and (i) bringing the vertical rolls into contact with the first and second horizontal rolls.

Preferably the horizontal roll which is axially adjusted is the second horizontal roll. It is also preferred that the first horizontal roll is the upper horizontal roll and the second horizontal roll is the lower horizontal roll.

The method of the invention in the preferred embodiment which will be described, can advantageously be carried out using automatic gap control systems, which are known per se, on each of the horizontal and vertical roll pairs.

DESCRIPTION OF PREFERRED EMBODIMENT

Figure 1:
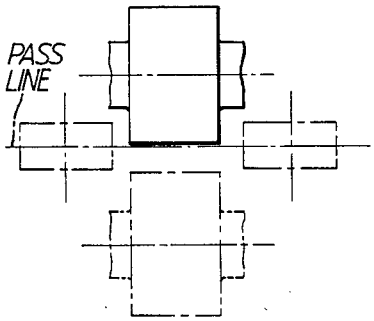
FIGS. 1 to 6 show progressive stages of the alignment of the rolls of a beam mill in accordance with the method of the preferred embodiments.

A preferred embodiment of the invention will now be described, by way of example and with reference to the accompanying drawings, wherein:

It is to be understood that the horizontal and vertical rolls of the beam mill shown in the drawings are mounted in a stand with the usual mechanisms for adjusting the positions of the horizontal and vertical rolls. In addition both the horizontal roll pair and the vertical roll pair have an automatic gap control system which is known per se for automatically controlling the gap of a single pair of rolls. As will be become apparent the automatic gap control systems are put to particular use in the method of the preferred embodiment.

Starting then with FIG. 1 and the preliminary steps of the method of the preferred embodiment, the roll sizes are supplied to the automatic roll-gap control system. The vertical rolls are retracted to a position approximately 30 mm clear of the horizontal rolls, and the bottom horizontal roll is lowered to its lowest position. The top horizontal roll is then positioned using the screw-down gear with the face of the top horizontal roll on the pass line.

Figure 2:
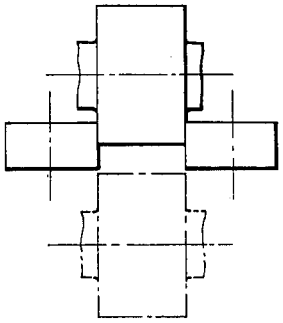

Referring to FIG. 2, hydraulic or automatic gap control (AGC) cylinders on the vertical rolls are extended, and the vertical rolls are traversed towards the top horizontal roll using the screw-in gear. Contact of the vertical rolls with the sides of the top horizontal roll is detected using pressure transducers on the vertical roll AGC system, and the inward traverse of the vertical rolls is stopped. The position transducers on the vertical roll AGC system are zeroed.

Figure 3:
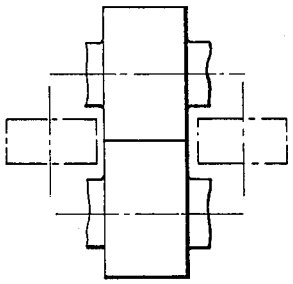

Moving on to FIG. 3, the vertical rolls are retracted about 15 mm using the AGC cylinders and the bottom horizontal roll raised using the screw-up gear. The pressure transducers on the horizontal roll AGC system are used to detect contact, of the horizontal rolls, and, of course, when the rolls contact upward movement of the lower horizontal roll is stopped. The position transducers on the horizontal AGC system are zeroed.

Figure 4:
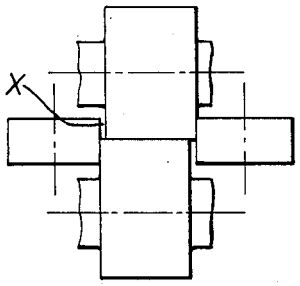

In the schematic diagram of FIG. 3 the horizontal rolls are in axial alignment, but this need not, and indeed normally will not, be the case. FIG. 4 illustrates the situation where the horizontal rolls are axially misaligned and the steps the method of the preferred embodiment takes to overcome this difficulty will now be described.

FIG. 4 shows the bottom horizontal roll offset to the left-hand side of the upper horizontal roll. It will of course be appreciated that in practice this offset could be to the left-hand or the right-hand side and if to the right-hand side the procedure to be described will be correspondingly altered.

Thus in FIG. 4 the, axially misaligned, top and bottom horizontal rolls have been brought into contact. The vertical rolls are traversed inwards using the AGC cylinders and contact of the vertical rolls with the horizontal rolls is detected using the pressure transducers on the AGC system. In the arrangement shown in FIG. 4 the right-hand vertical roll engages with the upper horizontal roll and is thus, by virtue of the zeroing already described with reference to FIG. 2, at the zero position. The left-hand vertical roll, on the other hand, engages with the bottom horizontal roll, and will be offset from the zero position by an amount "X" which will be detected by the vertical roll position transducers of the AGC system. The offset "X" of the left-hand vertical roll detected by the vertical roll AGC system corresponds to the axial misalignment of the horizontal rolls. This axial misalignment has now to be corrected.

Figure 5:
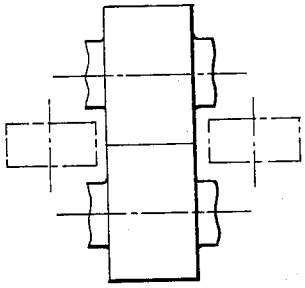

Thus referring to FIG. 5, the vertical rolls are retracted by 50 mm using the AGC system cylinders, and the bottom roll is lowered by 5 mm. The bottom horizontal roll is then axially adjusted by the amount of the measured error "X" by rotating the axial adjusting gear motor the required number of turns. The top and bottom horizontal rolls are thus correctly axially aligned.

Figure 6:
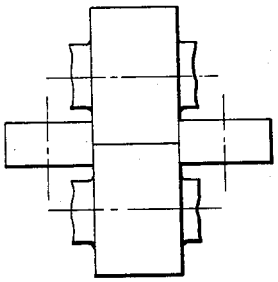

The adjustment of the rolls continues as shown in FIG. 6, with the bottom roll being raised into contact with the top roll, which contact is detected using the pressure transducers of the horizontal roll AGC system and, of course, movement of the bottom roll is stopped. The vertical rolls are then traversed inwards using the AGC capsules, so that they contact the aligned horizontal rolls. The axial adjustment of the vertical roll is now checked.

The horizontal and vertical rolls are now in a "zero" position ready to be set for a first pass of a schedule to be rolled. The required beam size can be programmed into the AGC system and because the correct zero position of the beam rolls has been established, beam of the correct size can readily be produced.

What is claimed is:

1. A method of aligning horizontal and vertical rolls of a beam mill stand comprising the steps of:

(a) bringing a first horizontal roll to a datum position, said first horizontal roll having opposite flanks;

(b) bringing the vertical rolls into a first contact with the opposite flanks of the first horizontal roll, to establish datum positions for the vertical rolls;

(c) withdrawing the vertical rolls from their datum positions;

(d) bringing a second horizontal roll into contact with the first horizontal roll to establish a datum position for the second horizontal roll, said second horizontal roll having opposite flanks; and (e) bringing the vertical rolls into a second contact with the flanks of the first and second horizontal rolls.

2. A method as claimed in claim 1, wherein there are the additional steps of:

(f) comparing the spacing of the vertical rolls at step (b) with the spacing of the vertical rolls at step (e) to determine if there is any axial misalignment of the horizontal work rolls;

(g) withdrawing the vertical rolls by a predetermined amount;

(h) separating the horizontal rolls, axially adjusting one of the horizontal rolls to correct the determined misalignment, and bringing the rolls together again; and (i) bringing the vertical rolls into a third contact with the flanks of the first and second horizontal rolls.

3. A method as claimed in claim 1, wherein the horizontal roll which is axially adjusted is the second horizontal roll.

4. A method as claimed in claim 1, wherein the first horizontal roll is the upper horizontal roll and the second horizontal roll is the lower horizontal roll.

5. A method as claimed in claim 2, wherein the horizontal roll which is axially adjusted is the second horizontal roll.

6. A method as claimed in claim 2, wherein the first horizontal roll is the upper horizontal roll and the second horizontal roll is the lower horizontal roll.

7. A method as claimed in claim 3, wherein the first horizontal roll is the upper horizontal roll and the second horizontal roll is the lower horizontal roll.

8. A method as claimed in claim 1, wherein hydraulic AGC equipment on the mill stand determines said contacts between the rolls, by sensing variations in pressure in the hydraulic system.

9. A method as claimed in claim 2, wherein hydraulic AGC equipment on the mill stand determines said contacts between the rolls, by sensing variations in pressure in the hydraulic system.

10. A method as claimed in claim 3, wherein hydraulic AGC equipment on the mill stand determines said contacts between the rolls, by sensing variations in pressure in the hydraulic system.

11. A method as claimed in claim 4, wherein hydraulic AGC equipment on the mill stand determines said contacts between the rolls, by sensing variations in pressure in the hydraulic system.

* * * * *